US005294962A

United States Patent [19]

Sato et al.

[11] Patent Number: 5,294,962

[45] Date of Patent: Mar. 15, 1994

[54] CONTACT-TYPE ELECTROCONDUCTIVE BRUSH FOR ELECTRICALLY CHARGING AN IMAGE CARRIER OF AN IMAGE FORMING APPARATUS

[75] Inventors: Masaru Sato, Kodaira; Tetsuya Abe, Tama, both of Japan

[73] Assignees: Casio Electronics Manufacturing Co., Ltd.; Casio Computer Co., Ltd., both of Tokyo, Japan

[21] Appl. No.: 971,576

[22] Filed: Nov. 5, 1992

[30] Foreign Application Priority Data

Nov. 8, 1991 [JP] Japan ..... 3-091731[U]

[51] Int. Cl.[5] ..... G03G 15/02

[52] U.S. Cl. ..... 355/219; 361/221; 361/225

[58] Field of Search ..... 355/219, 250, 301, 210, 355/303; 361/221, 225, 230

[56] References Cited

U.S. PATENT DOCUMENTS

| | | | |
|---|---|---|---|
| 4,455,078 | 6/1984 | Mukai et al. | 361/221 X |
| 4,555,171 | 11/1985 | Clouthier et al. | 361/225 X |
| 4,706,320 | 11/1987 | Swift | 355/219 |
| 4,761,709 | 8/1988 | Ewing et al. | 355/225 |
| 4,791,455 | 12/1988 | Yamamoto et al. | 355/303 |
| 4,835,807 | 6/1989 | Swift | 355/250 X |
| 4,994,855 | 2/1991 | Ohashi et al. | 355/219 |
| 5,010,441 | 4/1991 | Fox et al. | 355/219 X |
| 5,060,016 | 10/1991 | Wanou et al. | 355/219 |
| 5,081,504 | 1/1992 | Morisawa et al. | 355/219 X |
| 5,196,892 | 3/1993 | Mitsuaki | 355/219 X |
| 5,225,878 | 7/1993 | Asano et al. | 355/219 |
| 5,227,851 | 7/1993 | Yoshida et al. | 361/225 X |
| 5,241,342 | 8/1993 | Asano et al. | 355/219 |

FOREIGN PATENT DOCUMENTS

| | | |
|---|---|---|
| 60-24556 | 2/1985 | Japan . |
| 60-86582 | 5/1985 | Japan . |
| 61-73984 | 4/1986 | Japan . |
| 62-168171 | 7/1987 | Japan . |
| 1-150150 | of 1989 | Japan . |
| 3-35551 | of 1991 | Japan . |

*Primary Examiner*—A. T. Grimley
*Assistant Examiner*—Shuk Y. Lee
*Attorney, Agent, or Firm*—Nixon & Vanderhye

[57] ABSTRACT

An image forming apparatus includes an image carrier which is rotated in a predetermined direction, a brush charger which charges a surface of the carrier, an exposure unit which forms an electrostatic latent image on the charged surface of the carrier in accordance with image information supplied thereto, a developer which develops the electrostatic latent image with a toner, and a transfer unit which transfers a toner image from the surface of the carrier onto a transfer medium supplied thereto. The image carrier includes a conductive main body, an undercoat having a predetermined electric resistance higher than that of the main body, and a photosensitive layer, which is formed on the undercoat, and on which an electrostatic latent image is formed by the exposure unit after charging is performed by the charger. The charger includes a main body constituted by bristles consisting of conductive fibers having electric resistance within the range from about $10^6$ to about $10^9$ Ω/cm, a conductive base cloth, which has an electric resistance lower than that of each of the brush bristles, and on which the bristles are furnished, and a base member to which the base cloth is fixed, and a voltage applying unit for applying a predetermined voltage to the base cloth. And, the bristles contact the photosensitive layer of the carrier by a predetermined length.

4 Claims, 4 Drawing Sheets

CONTACT-TYPE ELECTROCONDUCTIVE BRUSH FOR ELECTRICALLY CHARGING AN IMAGE CARRIER OF AN IMAGE FORMING APPARATUS

BACKGROUND OF THE INVENTION

1. Field of the Invention

The present invention relates to an image forming apparatus comprising an image carrier which is rotated in a predetermined direction, charging means for charging the peripheral surface of the image carrier, printing means for forming an electrostatic latent image on the charged peripheral surface of the image carrier in accordance with image information, developing means for developing the electrostatic latent image with a toner, and transfer means for transferring the toner image from the peripheral surface of the image carrier onto a transfer medium and, more particularly, to an image forming apparatus having a brush charger as the charging means.

2. Description of the Related Art

The above-described image forming apparatus is widely known as an apparatus of an electrophotographic type, which is used for, e.g., a printer, a copying machine, and a facsimile apparatus.

In such a conventional image forming apparatus, a corona charger is used as charging means. The corona charger serves to charge the peripheral surface of an image carrier by corona discharge. The corona charger requires a high voltage of several kV or more to generate corona discharge. In addition, the following problems are appeared in this charger. Upon corona discharge, the corona charger generates a large amount of ozone to adversely affect the image carrier (photosensitive member) and its neighboring members and environment. It is also difficult to reduce the size of the corona charger.

Under the circumstances, the use of a brush charger as charging means is proposed, as disclosed in, e.g., U.S. Pat. No. 5,060,016. The brush charger requires a relatively low voltage of about 1 kV and generates no ozone during its operation. In addition, the size of the brush charger is greatly smaller than that of the corona charger.

FIG. 1 shows the basic structure of the brush charger. In this case, a brush charger 10 is constructed by bonding a conductive base cloth **10*b*, on which a large number of conductive brush bristles 10*a* are furnished, to a conductive base plate 10*d* with a conductive adhesive 10*c***.

The large number of conductive brush bristles **10*a* are in contact with the peripheral surface of a photosensitive drum 12 as an image carrier. When a power supply (not shown) supplies a direct current to the brush charger 10 at a voltage of about 1 kV and the photosensitive drum 12 is rotated in a predetermined direction A at a predetermined speed, th peripheral surface of the photosensitive drum 12** is charged.

Printing means, toner developing means, transfer means, and toner cleaning means, all of which are well known, are arranged along the peripheral surface of the photosensitive drum 12 in the above described order from the brush charger 10 in the rotational direction of the photosensitive drum 12. The printing means forms an electrostatic latent image on the charged region of the peripheral surface of the photosensitive drum 12 in accordance with image information supplied to the printing means. The toner developing means develops the electrostatic latent image with a toner. The transfer means transfers the toner image, formed on the peripheral surface of the photosensitive drum 12, onto a transfer medium such as a paper sheet supplied to the transfer means. The toner cleaning means removes the residual toner on the peripheral surface of the photosensitive drum 12 after the toner image is transferred onto the paper sheet.

Although the brush charger has the above-described various merits as compared with the conventional corona charger, it also has the following demerits based on the fact that the brush charger is in direct contact with the peripheral surface of the photosensitive drum 12.

The first demerit is the instability of a charging property. Electric resistance of the conductive brush bristles **10*a* easily varies with changes in environmental conditions, especially temperature and humidity. In addition, as shown in FIG. 2, when the electric resistance of the conductive brush bristles 10*a* exceeds about $10^8$ Ω/cm, the surface electric potential (charging property) on the photosensitive drum 12 decreases. Especially, when the former value exceeds $10^9$ Ω/cm, the latter value abruptly decreases. If, therefore, conductive brush bristles 10*a* having an electric resistance exceeding about $10^9$ Ω/cm are used, a difference in electric resistance as high as about 1 MΩ/cm is caused even in the same brush charger 10 with changes in environmental conditions, and therefore the surface electric potential (charging property) of the photosensitive drum 12 generated by such a conductive brush bristles 10*a*** is widely changed.

The second demerit is nonuniformity of electric charge. If the brush charger 10 is formed by using the conductive brush bristles **10*a* having a wide range of having electric resistance exceeding about $10^9$ Ω/cm, variations in electric resistance with changes in environmental conditions are increased especially in the conductive brush bristles having electric resistance exceeding about $10^9$ Ω/cm. Consequently, large nonuniformity of electric resistance occurs in one brush charger 10, resulting in large nonuniformity of surface electric potential (charging property) generated on the peripheral surface of the photosensitive drum 12**.

On a paper sheet on which a toner image is transferred, the nonuniformity of electric charge appears as a stain on a white background or a blank portion on a black background.

In order to eliminate the first and second demerits, it is required that only the conductive brush bristles **10*a*** having electric resistances lower than about $10^9$ Ω/cm be used.

The third demerit is that if the electric resistance of the conductive brush bristles **10*a* is too low, a large leakage current is generated between a conductive main body 12*b* of the photosensitive drum 12 and the brush charger 10 when pinholes 12*c* or scratches are formed in a conductive layer or a photosensitive layer 12*a* on the peripheral surface of the photosensitive drum 12**.

Although this leakage current varies depending on the voltage of the power supply for the brush charger or the electric resistance of the brush charger, it reaches as high as several thousands μA and may produce spark discharge.

If a leakage current is generated, a power supply fuse is cut off or a local charge failure is produced in the peripheral surface of the photosensitive drum 12. Since this charge failure portion, together with an electrostatic latent image, is developed with a toner, if the charge failure portion is not included in the electrostatic latent image, a non-intended transfer toner image corresponding to the charge failure portion is appeared on a region of a white background of a paper sheet prepared for being transferred with a toner image.

If spark discharge is generated, a spark discharged part of the peripheral surface of the photosensitive drum 12 and/or the corresponding conductive brush bristles 10a are burnt and damaged.

In order to prevent the generation of a leakage current, the conductive brush bristles 10a are required to have electric resistance exceeding about $10^8$ Ω/cm.

As described in detail above, in order to prevent the above described three demerits from appearing in the use of the brush charger 10, the electric resistance of the brush charger 10 is required to fall at least within the range from about $10^8$ Ω/cm to about $10^9$ Ω/cm.

It is, however, technically difficult to manufacture only conductive brush bristles 10a having such a narrow range of electric resistance. In addition, it requires much labor and cost to select only conductive brush bristles 10a having the above-mentioned specific narrow range of electric resistance from a large number of conductive brush bristles 10a having a wide range of electric resistance.

Published Unexamined Japanese Patent Application No. 1-150510 discloses a photosensitive drum designed to prevent the generation of the above-mentioned leakage current.

In this known photosensitive drum, an undercoat layer having a predetermined electric resistance is interposed between the peripheral surface of a conductive main body consisting of aluminum, steel, stainless, or the like and a conductive layer or a photosensitive layer formed on the peripheral surface. The undercoat layer is required to prevent a leakage current from being generated between conductive brush bristles, which are in contact with the conductive layer or the photosensitive layer formed on the undercoat layer, and the conductive main body under the undercoat layer even if pinholes or scratches are formed in the conductive layer or the photosensitive layer. However, the undercoat layer must not have too high in an electric resistance to prevent a printing means from forming a clear electrostatic latent image on the photosensitive drum.

The above describe application discloses that an undercoat layers can be constituted by the following materials: a synthetic resin film having a predetermined conductivity, a metal deposition film, a metal plating film, a metal foil, a mixture of a binder and a metal powder or a composite metal oxide containing $Al_2O_3$, and a mixture of a metal-oxide-based conductive material and a thixotropic agent of calcite type calcium carbonate.

Published Unexamined Japanese Utility Model Application No. 3-35551 discloses a brush charger in which a desired electric resistance falling within the range of about $10^6$ Ω/cm to about $10^8$ Ω/cm is achieved as a whole in such a manner that flexible conductive brush bristles having electric resistances of about $10^3$ Ω/cm or less and no humidity dependence are fixed to an electrode with a conductive intermediate layer, which has a relatively high electric resistance of about $10^6$ Ω/cm to about $10^{13}$ Ω/cm and no humidity dependence, being interposed therebetween.

In this conventional brush charger, however, electric resistance generated by a combination of each conductive brush bristle and the conductive intermediate layer tend to vary easily. Therefore, relatively large nonuniformity of electric resistance tends to occur in the brush charger as a whole.

Furthermore, in this conventional case, the manufacturing process is complicated by an operation of combining two types of conductive materials, resulting in an increase in manufacturing cost.

SUMMARY OF THE INVENTION

The present invention has been made in consideration of the above situation, and an object of the invention is to provide an image forming apparatus which comprises an image carrier rotated in a predetermined direction, charging means for charging the surface of the image carrier, printing means for forming an electrostatic latent image on the charged surface of the image carrier in accordance with image information, developing means for developing the electrostatic latent image with a toner, and transfer means for transferring the toner image from the surface of the image carrier onto a transfer medium, the charging means being a brush charger, and which can effectively eliminate drawbacks specific to the brush charger, e.g., the unstable charging property, the nonuniformity of electric charge, and the current leakage, and can be easily manufactured.

In order to achieve the above object, according to the present invention, there is provided an image forming apparatus, comprising: an image carrier which is rotated in a predetermined direction; charging means for charging a surface of the image carrier; printing means for forming an electrostatic latent image on the charged surface of the image carrier in accordance with image information supplied thereto; developing means for developing the electrostatic latent image with a toner; and transfer means for transferring a toner image from the surface of the image carrier onto a transfer medium supplied thereto, wherein the charging means is a brush charger, the image carrier includes a conductive main body, an undercoat layer having a predetermined electric resistance higher than that of the conductive main body, and a conductive layer or a photosensitive layer, which is formed on the undercoat layer, and on which an electrostatic latent image is formed by the printing means after charging is performed by the charging means, the brush charger includes a brush main body constituted by brush bristles consisting of conductive fibers having electric resistance within the range from about $10^6$ Ω/cm to about $10^9$ Ω/cm, a conductive base cloth, which has an electric resistance lower than that of each of the brush bristles, and on which the brush bristles are furnished, and a base member to which the conductive base cloth is fixed, and voltage applying means for applying a predetermined voltage to the conductive base cloth, and the brush bristles of the brush charger are brought into contact with the conductive layer or the photosensitive layer of the image carrier by a predetermined length.

In the image forming apparatus according to the present invention and characterized by being constructed as described above, even if pinholes or scratches are formed on the conductive layer or the photosensitive layer of the image carrier, the undercoat layer of the image carrier prevents the brush bristles of the brush charger from directly coming into contact with the conductive main body of the image carrier through the pinholes or the scratches, thereby preventing a leakage current from flowing from the brush charger to the image carrier through the brush bristles.

In addition, according to the present invention, the brush main body is constituted by brush bristles which are consisted of conductive fibers having electric resistance within the range from about $10^6$ Ω/cm to about $10^9$ Ω/cm to prevent instability of a charging property and nonuniformity of electric charge on the image carrier from appearing, a conductive base cloth, which has an electric resistance lower than that of each of the brush bristles, and on which the brush bristles are furnished, and a base member to which the conductive base cloth is fixed.

Since the image carrier includes the undercoat layer, a leakage current can be effectively prevented. Therefore, brush bristles which are consisted of conductive fibers having electric resistance within a relatively wide range from about $10^6$ Ω/cm to about $10^9$ Ω/cm can be used. The brush main body can be easily constituted by the brush bristles and the conductive base cloth.

Brush bristles which are consisted of conductive fibers having lower electric resistances than about $10^6$ Ω/cm are not used to prevent the generation of a large leakage current when the brush bristles of the brush charger laterally protrude from a side edge of the image carrier and come into contact with the conductive main body exposed in the side edge of the image carrier. At least spark discharge can be prevented.

In the image forming apparatus according to the present invention and characterized by being constructed as described above, the conductive main body of the image carrier is preferably made of iron, stainless steel, aluminum, or a conductive resin.

In the image forming apparatus according to the present invention and characterized by being constructed as described above, it is preferable that the predetermined electric resistance of the undercoat layer of the image carrier is about $10^9$ Ω to about $10^{10}$ Ω, the thickness of each of the brush bristles is about 5 denier to about 10 denier, the length of each of the brush bristles is about 5.0 mm to about 9.0 mm, the predetermined length by which the brush bristles are brought into contact with the conductive layer or the photosensitive layer of the image carrier is about 1.0 mm to about 3.0 mm, the density of the brush bristles on the conductive base cloth is about 80,000 bristles/square inches to about 150,000 bristles/square inches, and the predetermined voltage applied from voltage applying means to the conductive base cloth is a DC voltage of about 1,000 V.

Moreover, in the image forming apparatus according to the present invention and characterized by being constructed as described above, a portion of the conductive base cloth of the brush charger, which is located on the upstream side in the predetermined rotational direction of the image carrier, is preferably bent and hooked on a corresponding portion of the base member. It is further preferable that the brush charger comprises separate fixing means for fixing the upstream side portion to the corresponding portion of the base member.

Since the brush bristles of the brush charger are always in contact with the image carrier, a large tensile force acts on the upstream side portion of the conductive base cloth on which the brush bristles are furnished, when the image carrier is rotated in the predetermined direction. The upstream portion of the conductive base cloth tends to be separated from the base member by the large tensile force.

The structure in which the upstream side portion of the conductive base cloth is bent and hooked on the corresponding portion of the base resists the tendency that the upstream side portion of the conductive cloth is separated from the corresponding portion of the base member.

The above-described separate fixing means serves as a stronger resistance to such a tendency.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE PREFERRED EMBODIMENTS

Figure 1:
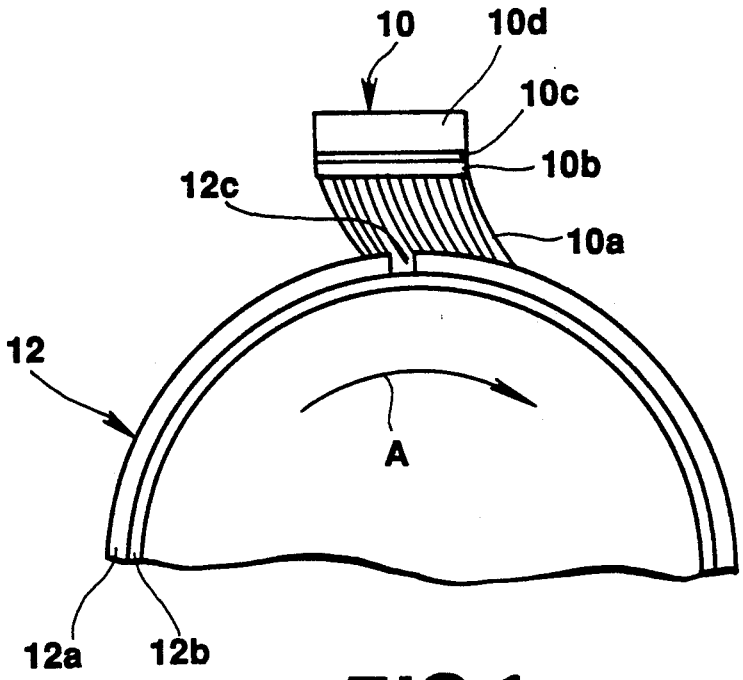
FIG.1 (PRIOR ART)
FIG. 1 is a schematic cross-sectional view showing a brush charger and a photosensitive drum as an image carrier for which the brush charger operates in a conventional image forming apparatus.
Figure 2:
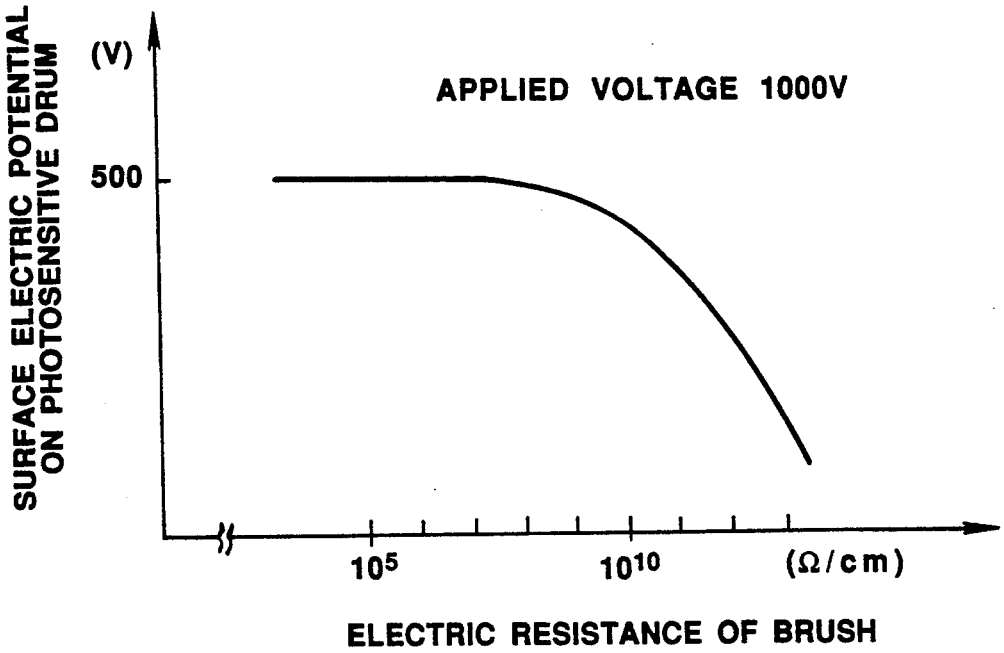
FIG.2 (PRIOR ART)
FIG. 2 is a graph showing a relationship between the electric resistance of brush bristles of the brush charger and the surface electric potential on a photosensitive drum charged by the brush bristles.
Figure 3:
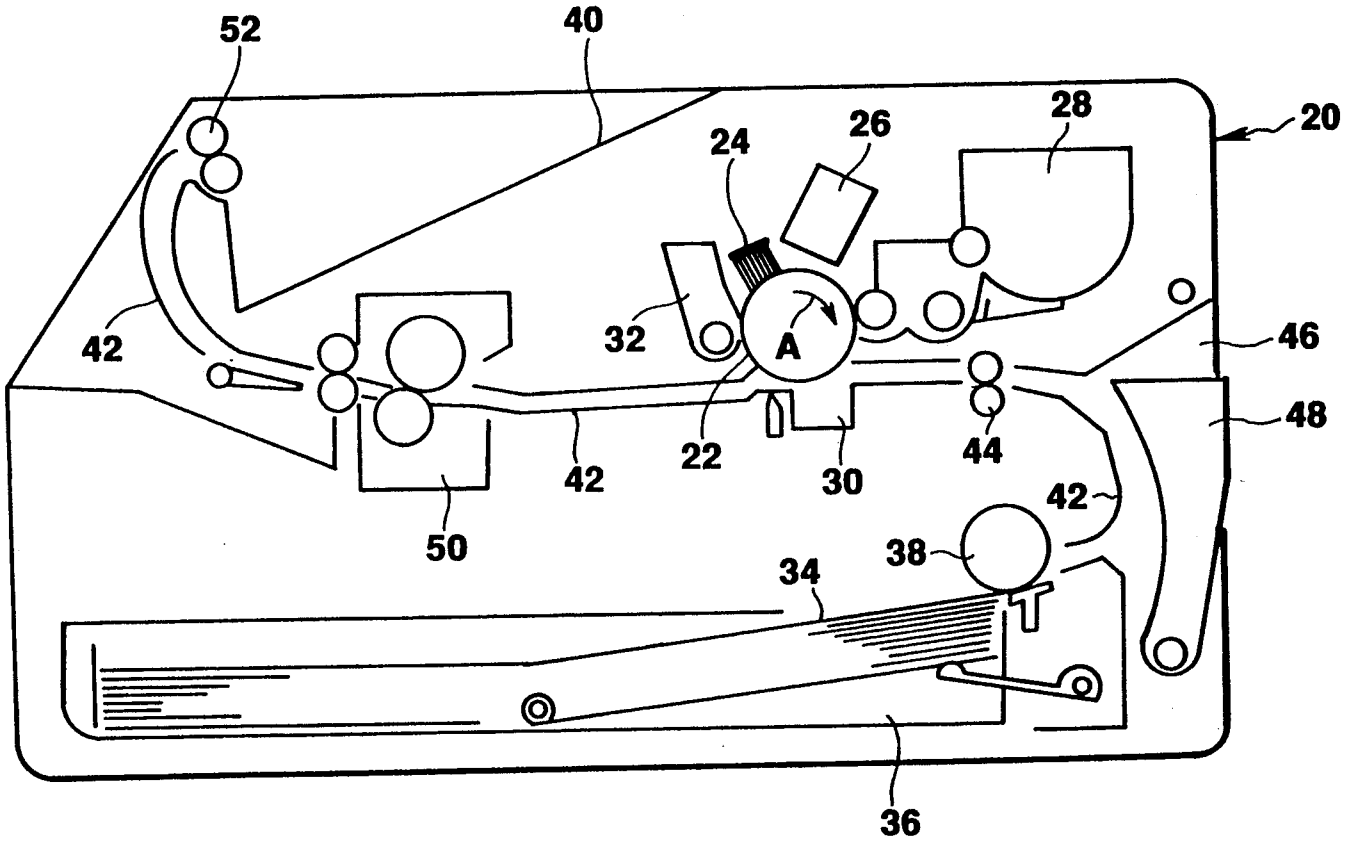
FIG. 3 is a longitudinal sectional view showing a schematic arrangement of a printer as an image forming apparatus according to an embodiment of the present invention.

FIG. 3 shows a schematic arrangement of a printer as an image forming apparatus according to an embodiment of the present invention.

A photosensitive drum 22 as an image carrier is arranged in almost the center of the inner space of an outer housing 20 of the printer so as to be rotated at a predetermined speed in a predetermined direction (the clockwise direction indicated by an arrow A in FIG. 3). A brush charger 24 as charging means, an exposure unit 26 as electrostatic latent image printing means, a toner developing means 28, a transfer means 30, and a cleaner 32 are sequentially arranged along the peripheral surface of the photosensitive drum 22 in the predetermined direction from the upper end of the peripheral surface. The brush charger 24 uniformly charges a photosensitive layer on the peripheral surface of the photosensitive drum 22 while the drum 22 is rotated at the predetermined speed in the predetermined direction. The exposure unit 26 exposes the charged photosensitive layer of the photosensitive drum 22 in accordance with image information, thus forming an electrostatic latent image. The toner developing means 28 develops the electrostatic latent image with a toner. The transfer means 30 transfers the toner image from the photosensitive layer of the photosensitive drum 22 onto a transfer medium such as a paper sheet supplied to the transfer means 30. The cleaner 32 removes the residual toner on the photosensitive layer of the photosensitive drum 22.

A paper cassette 36, in which a large number of paper sheets 34 of a predetermined size are held, is detachably arranged at a lower end portion in the inner space. A pickup roller 38 for picking up the paper sheets 34 one by one from the paper cassette 36 is disposed above one end portion of the paper cassette 36. A paper guide 42 extends from the pickup roller 38 to a delivery tray 40, formed on the upper surface of the outer housing 20, through the transfer means 30 disposed at a lower end portion of the peripheral surface of the photosensitive drum 22.

The paper sheet 34 picked up from the paper cassette 36 by the pickup roller 38 is guided by the paper guide 42 to a register roller pair 44 disposed immediately before the transfer means 30. An inner end of a manual insertion paper guide 48 extending from a manual insertion slit 46 formed in a rear side surface of the outer housing 20 is also connected to the paper guide 42 at a position between the pickup roller 38 and the register roller pair 44. The paper sheet 34 supplied from the paper cassette 36 or the manual insertion slit 46 to the paper guide 42 is aligned by the register roller pair 44 such that the leading edge of the paper sheet 34 becomes perpendicular to the moving direction of the paper sheet 34 in the paper guide 42. Subsequently, as a toner image developed on the photosensitive layer of the photosensitive drum 22 by the toner developing means 28 approaches the transfer means 30, the paper sheet 34 is conveyed from the register roller pair 44 to the transfer means 30. The toner image is then transferred from the photosensitive layer of the photosensitive drum 22 onto the paper sheet 34 by the transfer means 30. The paper sheet 34 is further conveyed to a fixing unit 50 through the paper guide 42 to be fixed. The paper sheet 34 on which the toner image is fixed when the paper sheet 34 passes through the fixing unit 50 is further conveyed to an extended end of the paper guide 42, which is open above the delivery tray 40. The paper sheet 34 is then delivered onto the delivery tray 40 by a delivery roller pair 52 disposed at the extended end.

The above-described arrangement of the printer is known.

Figure 4:
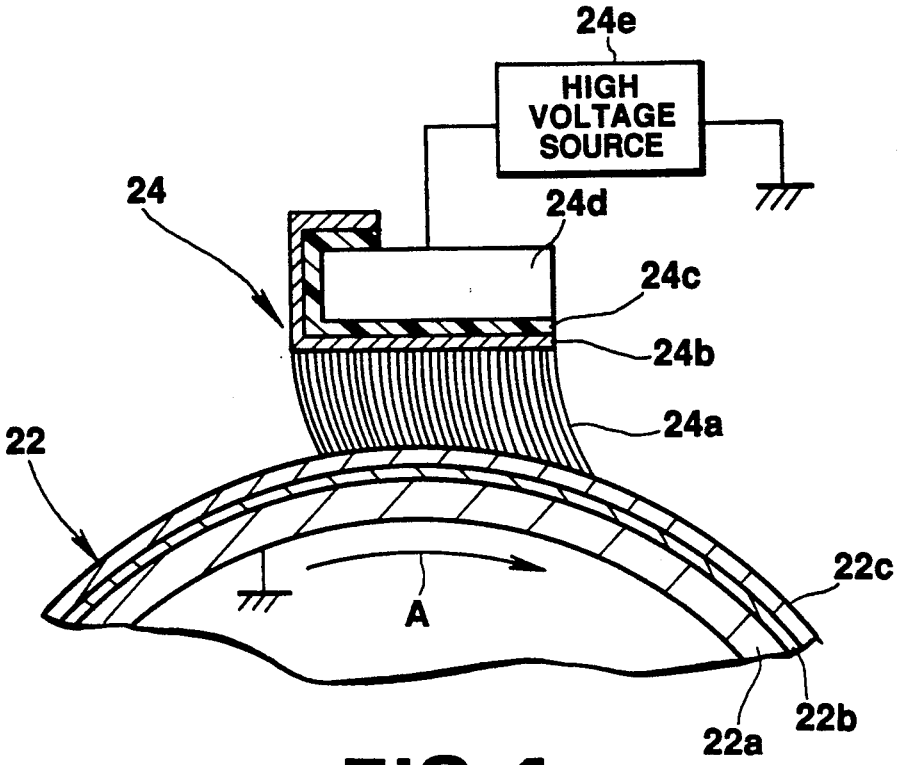
FIG. 4 is a cross-sectional view showing detailed structures of a photosensitive drum and a brush charger as main parts of the printer in FIG. 3.

The structures of the photosensitive drum 22 and the brush charger 24 as main parts of the present invention will be described in detail below with reference to FIG. 4.

The photosensitive drum 22 in this embodiment is constituted by a main body 22*a* formed of aluminum, an undercoating layer 22*b* formed by anodizing the peripheral surface of the main body 22*a*, and a photosensitive layer 22*c* formed on the undercoating layer 22*b*. The electric resistance of the undercoating layer 22*b* is higher than that of the main body 22*a* but is not so high as to adversely affect a charging operation (i.e., the charging property of the photosensitive layer 22*c*) by the brush charger 24 or the formation of a sharp electrostatic latent image (i.e., the photoconductivity of the photosensitive layer 22*c*) by the exposure unit 26. In this embodiment, for example, the electric resistance of the undercoating layer 22*b* is set to be about $10^9$ Ω to about $10^{10}$ Ω. Note that the main body 22*a* may be made of iron, stainless steel, a conductive resin, or the like.

The brush charger 24 includes a brush main body which is constituted by a large number of brush bristles 24*a*, a conductive base cloth 24*b* on which the conductive brush bristles 24*a* are furnished, and a conductive base member 24*d* on which the conductive base cloth 24*b* is fixed 24*d* with a conductive adhesive 24*c*. Each of the brush bristles 24*a* is made of a conductive fiber and is in contact with the photosensitive layer 22*c* of the photosensitive drum 22 by a predetermined length. The conductive base member 24*d* extends along the rotational center line of the photosensitive drum 22 by a length corresponding to the length of the photosensitive drum 22. An end portion of the conductive base cloth 24*b*, located on the upstream side in a predetermined rotational direction of the photosensitive drum 22 indicated by an arrow A, is bent around the upstream end portion of the conductive base member 24*d* and is bonded thereto. Note that no brush bristles 24*a* are furnished on the upstream end portion of the conductive base cloth 24*b* to reinforce the fixed state of the upstream end portion of the conductive base cloth 24*b* to the conductive base member 24*d*.

A high voltage source 24*e* is connected to the conductive base member 24*d*. The high voltage source 24*e* applies a high DC voltage of about 1 kV to the conductive base member 24*d*.

In the embodiment, the brush bristles 24*a* have an average electric resistance of about $10^6$ Ω/cm to about $10^9$ Ω/cm, a thickness thereof is about 500 denier/100 bristles to about 400 denier/40 bristles (about 5 denier to about 10 denier per bristle), a total length of each bristle is about 5.0 mm to about 9.0 mm, and a contact length of each bristle is about 1.0 mm to about 3.0 mm, by which each bristle is in contact with the photosensitive layer 22*c* of the photosensitive drum 22. The bristle density of the brush bristles 24*a* on the conductive base cloth 24*b* is about 80,000 bristles/square inches to about 130,000 bristles/square inches, specifically about 100,000 bristles/square inches.

Each of the electric resistances of the conductive base cloth 24*b*, the conductive adhesive 24*c*, and the conductive base member 24*d* is lower than the average electric resistance of the brush bristles 24*a*.

The above-mentioned various values of the brush bristles 24*a* are set on the basis of various experiments conducted by the present inventors. These various experiments will be described in the following.

The present inventors found the relationship between the length of each brush bristle and image troubles caused by leakage currents in a photosensitive drum having no undercoat layer.

A brush main body of a brush charger used in this experiment was constituted by brush bristles, each consisting of a conductive rayon fiber, a conductive base cloth on which the brush bristles were furnished, and a conductive base member to which the conductive base cloth was bonded with a conductive adhesive. The conductive base member was made of aluminum. A photosensitive drum used in the experiment was constituted by an aluminum main body and a photosensitive layer directly formed on the peripheral surface of the main body without interposing an undercoat layer therebetween.

The photosensitive drum had a diameter of about 40 mm and was rotated at a rotational speed of about 35.5 mm/sec. The electric resistance of the brush charger became about $1\times10^6\ \Omega$/cm to about $1\times10^7\ \Omega$/cm when the brush bristles of the brush charger were brought into contact with the peripheral surface of the photosensitive drum by a length of about 1 mm.

A power supply with a limit current of 100 $\mu$A was connected to the brush main body. Five photosensitive drums A to E of the same type as that described above and having same scratches on their photosensitive layers were prepared.

Four types of brush main bodies respectively constituted by brush bristles having lengths of 3 mm, 5 mm, 7 mm, and 9 mm were prepared.

Two different voltages −1.0 kV and −1.1 kV were applied to the respective photosensitive drums. During application of the respective voltages, the brush main bodies having brush bristles of different lengths were used, thus determining the degree of contamination of each toner image under the influence of a voltage drop caused by a leakage current. The result is shown in Table 1 as follows:

TABLE 1

| APPLIED VOLTAGE | DRUM | LENGTH OF BRUSH BRISTLE 3 mm | 5 mm | 7 mm | 9 mm |
|---|---|---|---|---|---|
| −1.0 kV | A | x | o | ◎ | ◎ |
| | B | ◎ | ◎ | ◎ | ◎ |
| | C | x | o | ◎ | ◎ |
| | D | o | ◎ | ◎ | ◎ |
| | E | x | ◎ | ◎ | ◎ |
| −1.1 kV | A | x | x | ◎ | ◎ |
| | B | x | o | ◎ | ◎ |
| | C | x | x | ◎ | ◎ |
| | D | x | ◎ | ◎ | ◎ |
| | E | x | x | o | ◎ |

In Table 1, the "x" indicates that a large voltage drop occurs and obvious contamination occurred on a toner image (a black toner stain on the white background on a transfer medium). The sign "o" indicates that a slightly large voltage drop occurs but obvious contamination does not occurred on a toner image. The sign "◎" indicates that a large voltage drop does not occur and no obvious contamination occurred on a toner image.

As is apparent from this result, as the length of each brush bristle is increased, no large leakage current is generated, and hence no contamination on a toner image under the influence of a voltage drop caused by a leakage current occurs. When the length of each brush bristle is 5 mm or more, a substantially satisfactory effect can be obtained.

The reason for this is considered as follows. As the length of each brush bristle is increased, the resistance to current leakage is increased to reduce a leakage current flowing from the brush bristles of the brush main body of the brush charger into the main body of the photosensitive drum through scratches on the photosensitive layer of the photosensitive drum.

Figure 5:
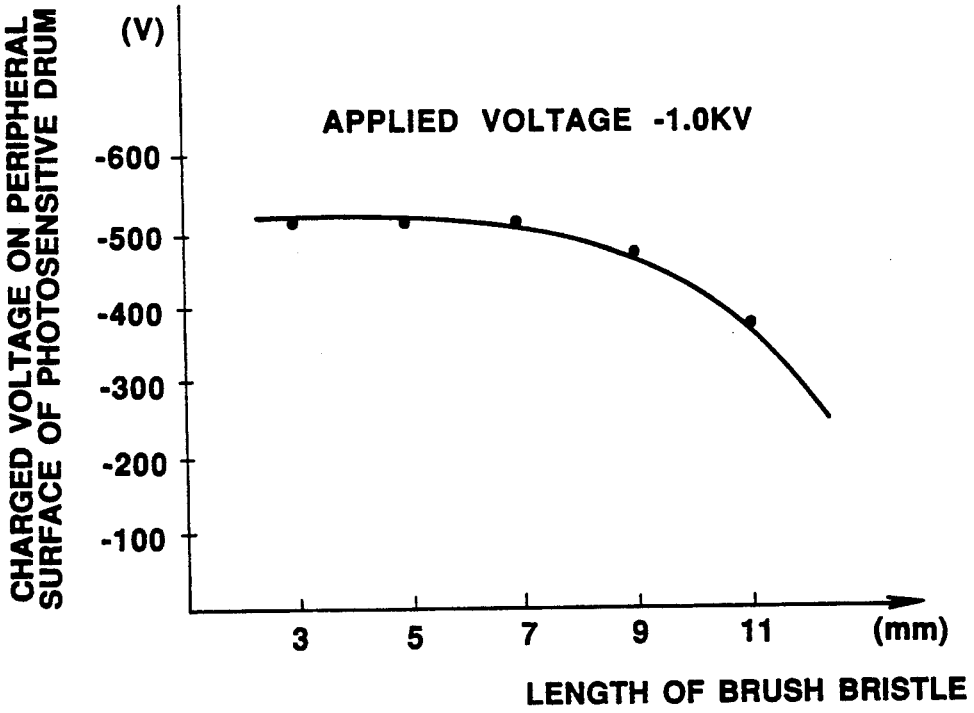
FIG. 5 is a graph showing a relationship between the length of brush bristles of the brush charger and the charged voltage on the photosensitive drum charged by the brush charger.

The overall electric resistance of the brush bristles, however, is increased with an increase in length of each brush bristle. Consequently, the charged voltage on the photosensitive drum is reduced. In order to confirm this, the present inventors conducted an experiment in which a relationship between the length of each brush bristle and the charged voltage when the applied voltage to the brush charger was set to be −1.0 kV was obtained, and FIG. 5 shows the result of the experiment. It is apparent from this graph that if the length of each brush bristle is set to be about 9 mm or more, the charged voltage (about −500 V) normally required for the proper function of the photosensitive drum cannot be obtained.

It is found from the result of the experiment described above that the range of the length of each brush bristle, which has the sufficiently large resistance to current leakage and can provide the charged voltage (about −500 V) normally required for the proper function of the photosensitive drum, is about 5 mm to about 9 mm.

The thickness of each brush bristle, the density of brush bristles, and the contact length of each brush bristle were set in consideration of the nonuniformity of electric charge on a photosensitive drum.

In a conventional image forming apparatus using a brush charger, the thickness of each brush bristle on the brush main body of the brush charger is about 5 denier to about 10 denier, and the density of brush bristles is about 80,000 brush bristles/square inches to about 150,000 brush bristles/square inches. In such a conventional image forming apparatus, a large number of fine toner images like a pattern formed by sweeping with a broom tend to be formed on the white background on the surface of a transfer medium such as a paper sheet. It is considered that the reason for this tendency is that the peripheral surface of the photosensitive drum is charged by the tip of each of a large number of brush bristles of the brush charger.

In order to eliminate this tendency, the number of brush bristles which are in contact with the peripheral surface of the photosensitive drum may be increased by increasing the size of the brush main body itself in the rotational direction of the photosensitive drum or increasing the density of brush bristles. However, the increase in the size of the brush main body conflicts with the recent trend toward smaller image forming apparatuses. The increase in the density of brush bristles is limited in terms of manufacturing techniques.

The present inventors paid a great deal of attention to the contact length of each brush bristle with a photosensitive drum, and checked the relationship between the contact length and the nonuniformity of electric charge on the photosensitive drum by experiment. At the same time, the relationship between the contact length, the rotational torque of the photosensitive drum, and the wearing of the photosensitive layer of the photosensitive drum was checked by experiment. These results are shown in Table 2 as follows:

TABLE 2

| ITEM | CONTACT LENGTH OF BRUSH 0.5 mm | 1.0 mm | 2.0 mm | 3.0 mm | 4.0 mm | 5.0 mm |
|---|---|---|---|---|---|---|
| NONUNIFORMITY OF ELECTRIC CHARGE | x | o | o | o | o | o |
| ROTATIONAL TORQUE | o | o | o | o | o | x |
| WEARING OF PHOTOSENSITIVE LAYER | o | o | o | o | x | x |

In Table 2, the sign "o" represents a good result; and the sign "x" represents a bad result. As is apparent from this table, as the contact length of each brush bristle is increased, the nonuniformity of electric charge is reduced. However, since the friction between the photosensitive drum and the brush bristles of the brush main body of the brush charger is increased, the rotational torque and/or the wearing of the photosensitive layer is increased.

It is apparent from the above table that the range of contact lengths, which can obtain good results with respect to all the items, i.e., the nonuniformity of electric charge, the rotational torque, and the wearing of the photosensitive layer, is about 1.0 mm to about 3.0 mm.

In the present invention, in consideration of all the above-described experimental results, the thickness of each brush bristle is set to be 5 denier to 10 denier; the density thereof is set to be about 80,000 bristles/square inches to about 130,000 bristles/square inches; the total length thereof is set to be about 5 mm to about 9.0 mm; and the contact length thereof is set to be about 1.0 mm to about 3.0 mm.

The present inventors further conducted the following experiment under the following conditions according to the present invention.

A brush charger in this embodiment has a brush main body constituted by furnishing brush bristles, each consisting of a conductive rayon fiber having a thickness of about 6 denier, on a conductive base cloth at a density of about 100,000 bristles/square inches, cutting each brush bristle to a length of about 6 mm, and bonding the conductive base cloth to a conductive base member consisting of aluminum with a conductive adhesive. The electric resistance of this brush charger, measured by the same method as in the experiment associated with Table 1, was $5\times10^6$ Ω/cm.

The brush charger was disposed such that each brush bristle has a contact length of about 1 mm with respect to the photosensitive drum having a diameter of about 30 mm. The photosensitive drum was charged by application of a DC voltage of about −1.0 kV in each of the following environments: a low-temperature/low-humidity (5° C./20%) environment, a room-temperature/room-humidity (25° C./60%) environment, and a high-temperature/high-humidity (33° C./85%) environment.

In the low-temperature/low-humidity environment, the charged voltage on the peripheral surface of the photosensitive drum was −500 V; in the room-temperature/room-humidity environment, −530 V; and in the high-temperature/high-humidity environment, −600 V.

As is apparent from this result, a stable charging property can be obtained in a normal environment.

Continuous printing tests of 50,000 paper sheets in a printer were performed under the above described conditions. Even if fine scratches were formed on the photosensitive layer of the photosensitive drum, no leakage current was generated between the brush charger and the photosensitive drum, and no black stain caused by current leakage was produced on the white background of each paper sheet upon printing.

In this embodiment, the photosensitive drum 22 has the undercoat layer **22*b* between the main body 22*a* and the photosensitive layer 22*c*, and the undercoat layer 22*b* is anodized and have high hardness. Therefore, in addition to the fact that the brush main body of the brush charger is designed to inhibit easy generation of a leakage current, the undercoat layer 22*b* serves to more reliably prevent the generation of a leakage current generated by scratches on the photosensitive layer 22*c***.

Brush bristles having electric resistances within the range from about $10^6$ Ω/cm to about $10^9$ Ω/cm can be easily manufactured at a low cost. In addition, variations in electric resistance with changes in environmental conditions are small.

The above-described embodiment exemplifies the present invention. However, the present invention is not limited to this embodiment. Various changes and modifications can be made within the spirit and scope of the invention.

Figure 6A:
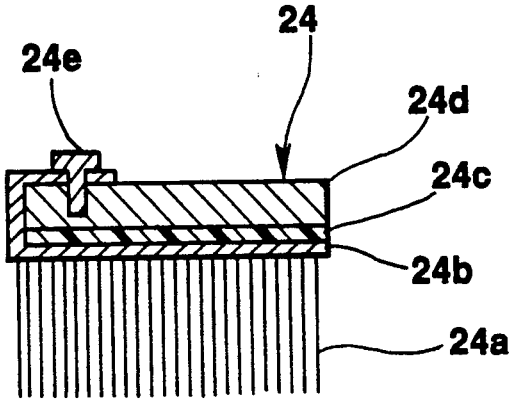
FIGS. 6(A) and 6(B) are cross-sectional views showing two modifications of the brush charger in the image forming apparatus of the present invention.
Figure 6B:
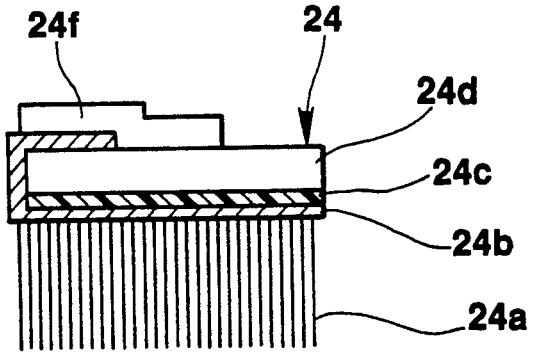

For example, as shown in FIG. 6(A), the portion of the conductive base cloth **24*b* of the brush main body of the brush charger, which is wrapped around the upstream end portion of the conductive base member 24*d* may be fixed to the upper surface of the conductive base member 24*d* with a separate fixing pin 24*e*. Alternatively, the portion may be fixed to the upper surface of the conductive base member 24*d* with a separate press board 24*f*, as shown in FIG. 6**(B).

In addition, the undercoat layer of the photosensitive drum may be made of a semiconductor resin film, a film formed by a mixture of a metal powder and a resin binder, a metal deposition film, a metal plating film, or the like as long as it has an electric resistance which is not so high as to generate a leakage current between the brush bristles of the brush charger and the main body of the photosensitive drum when pinholes or scratches are formed on the photosensitive layer, and it does not affect the characteristics of the photosensitive drum (that is, the charging property and a photoconductivity of the photosensitive layer relating to a production of a clear electrostatic latent image by the exposure unit).

Furthermore, in the above embodiment, a Carlson process using a photosensitive member as an image carrier is employed as an image formation process in the image forming apparatus. However, an electrostatic recording process may be employed instead. In this process, a dielectric layer is formed on the conductive main body of an image carrier. The dielectric layer is uniformly charged, and an image is formed on the uniformly charged dielectric layer by using a multi-stylus printing head.

Additional advantages and modifications will readily occur to those skilled in the art. Therefore, the invention in its broader aspects is not limited to the specific details, and representative devices shown and described herein. Accordingly, various modifications may be made without departing from the spirit or scope of the general inventive concept as defined by the appended claims and their equivalents.

What is claimed is:

1. An image forming apparatus comprising:

a charging device;

an image carrier rotatable in a predetermined direction for charging a surface of the image carrier;

a printing means for forming an electrostatic latent image on the charged surface of the image carrier in accordance with image information supplied thereto;

developing means for developing the electrostatic latent image with a toner; and transfer means for transferring a toner image from the surface of the image carrier onto a transfer medium supplied thereto;

said charging device has a contact-type electroconductive brush;

said image carrier including a conductive main body, an undercoat layer having a predetermined electric resistance higher than that of said conductive main body, the predetermined electric resistance being in a range from about $10^9$ Ω to about $10^{10}$ Ω, and a conductive layer or a photosensitive layer, which is formed on said undercoat layer, and on which an electrostatic latent image is formed by the printing means after charging is performed by said charging device;

said contact-type electroconductive brush including a brush main body constituted by brush bristles consisting of conductive fibers having electric resistance within a range from about $10^6$ Ω/cm to about $10^9$ Ω/cm, a conductive base cloth, which has an electric resistance lower than that of each of said brush bristles, and on which said brush bristles are furnished, and a base member to which said conductive base cloth is fixed, and voltage applying means for applying a predetermined voltage to said conductive base cloth, the predetermined voltage being a DC voltage of about 1,000 volts;

said brush bristles of said contact-type electroconductive brush being brought into contact with the conductive layer or the photosensitive layer of the image carrier along a predetermined length thereof; and each said brush bristle having a thickness of about 5 denier to about 10 denier, a length of about 5.0 mm to about 9.0 mm, the predetermined length by which said brush bristles are brought into contact with the conductive layer or the photosensitive layer of the image carrier being about 1.0 mm to about 3.0 mm, said brush bristles having a density on said conductive base cloth of about 80,000 bristles/square inch to about 150,000 bristles/square inch.

2. An apparatus according to claim 1, wherein said conductive main body of the image carrier is made of iron, stainless steel, aluminum, or a conductive resin.

3. An apparatus according to claim 1, wherein a portion of said conductive base cloth of contact-type electroconductive brush which is located on an upstream side in the predetermined rotational direction of the said image carrier, is bent and hooked on a corresponding portion of said base member.

4. An apparatus according to claim 3, wherein said contact-type electroconductive brush comprises separate fixing means for fixing the portion located on the upstream side to the corresponding portion of said base member.

* * * * *